US006085849A

United States Patent [19]

Scigliuto

[11] Patent Number: 6,085,849

[45] Date of Patent: Jul. 11, 2000

[54] PNEUMATIC SCREWDRIVER

[75] Inventor: Jean-Marc Scigliuto, Amphion les Bains, France

[73] Assignee: Ets Charles Maire, Evian les Bains cedex, France

[21] Appl. No.: 09/114,950

[22] Filed: Jul. 14, 1998

[30] Foreign Application Priority Data

Mar. 19, 1998 [FR] France ..... 98 03370

[51] Int. Cl.[7] ..... B25B 23/145

[52] U.S. Cl. ..... 173/178; 192/150

[58] Field of Search ..... 173/178; 192/150, 192/56.62; 81/475, 476, 474, 470; 477/178

[56] References Cited

U.S. PATENT DOCUMENTS

| | | | |
|---|---|---|---|
| 3,442,362 | 5/1969 | Bangerter | 173/178 |
| 4,006,785 | 2/1977 | Roll et al. | 173/178 |
| 4,019,589 | 4/1977 | Wallace | 173/178 |
| 4,071,092 | 1/1978 | Wallace | 173/178 |
| 4,576,270 | 3/1986 | Baltz et al. | 173/178 |
| 5,054,588 | 10/1991 | Thorp et al. | 173/178 |
| 5,060,772 | 10/1991 | Anders et al. | 173/178 |
| 5,156,244 | 10/1992 | Pyles et al. | 173/178 |
| 5,505,676 | 4/1996 | Bookshar | 173/178 |
| 5,558,168 | 9/1996 | Rahm | 173/178 |
| 5,701,983 | 12/1997 | Matsumoto | 192/54.52 |

FOREIGN PATENT DOCUMENTS

| | | |
|---|---|---|
| 0728958 | 8/1996 | European Pat. Off. . |
| 2382983 | 10/1978 | France . |
| 2602167 | 2/1988 | France . |
| 2460072 | 7/1976 | Germany . |

*Primary Examiner*—Peter Vo
*Assistant Examiner*—James P Calve
*Attorney, Agent, or Firm*—Greenblum & Bernstein, P.L.C.

[57] ABSTRACT

A pneumatic screwdriver incorporates a torque limiter for cutting off the supply of compressed air when the torque reaches a particular threshold. The invention includes a first positive clutch connected to a drive shaft and a second positive clutch connected to the tool. These components have three teeth offset by 120° facing each other with a groove in the teeth in which there is a boss. Balls are inserted between the positive clutches in order to separate them when the torque is reached to shut off the admission of compressed air and then escape from the bosses so that the teeth rub on each other to brake the drive shaft.

8 Claims, 12 Drawing Sheets

FIG.8
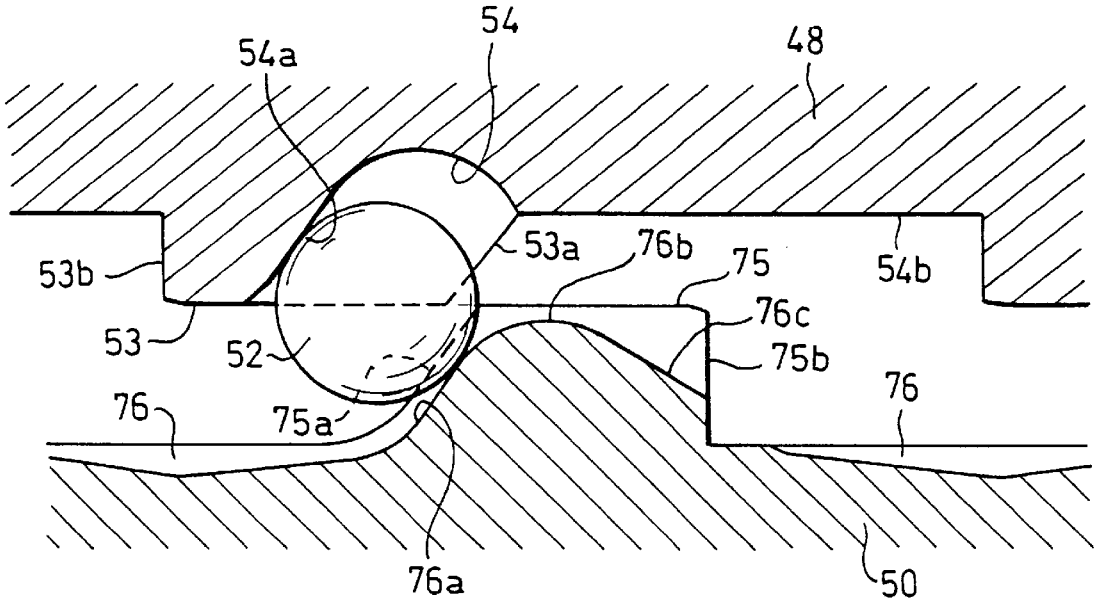
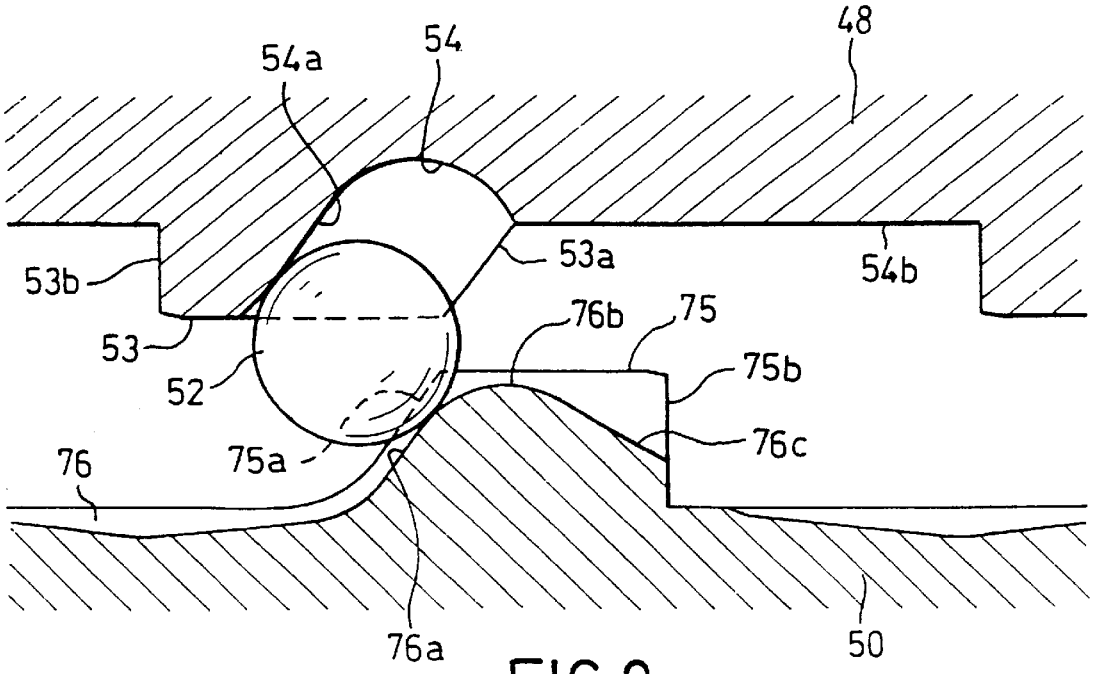
FIG.9

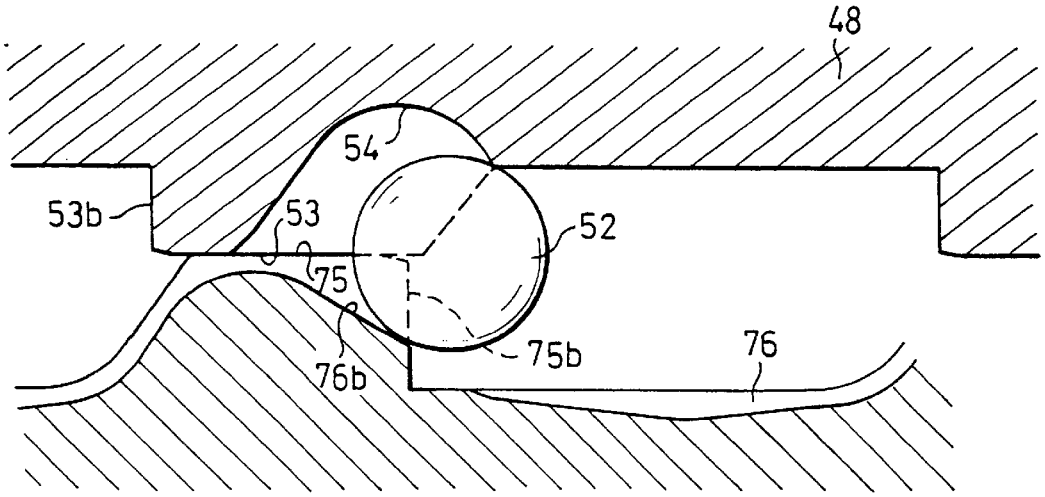
FIG.12
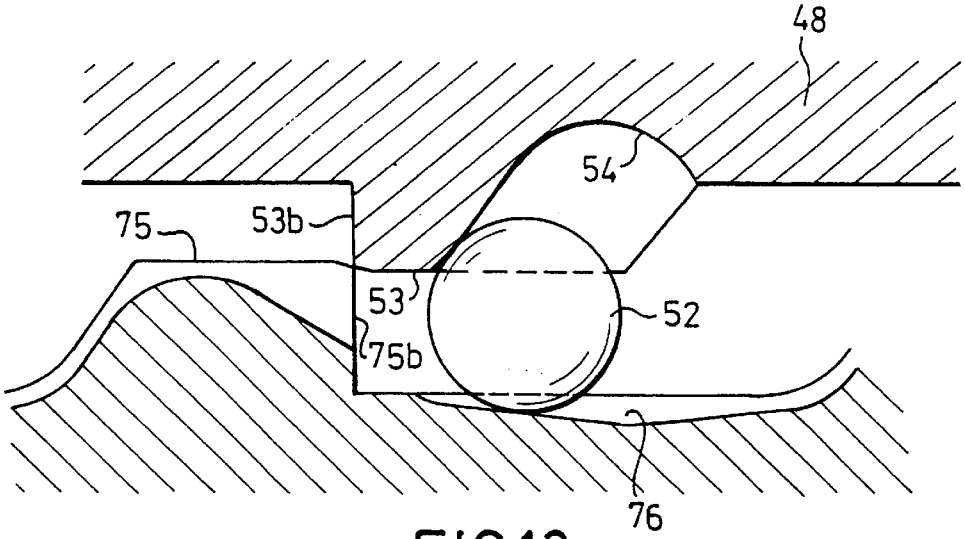
FIG.13
FIG.14
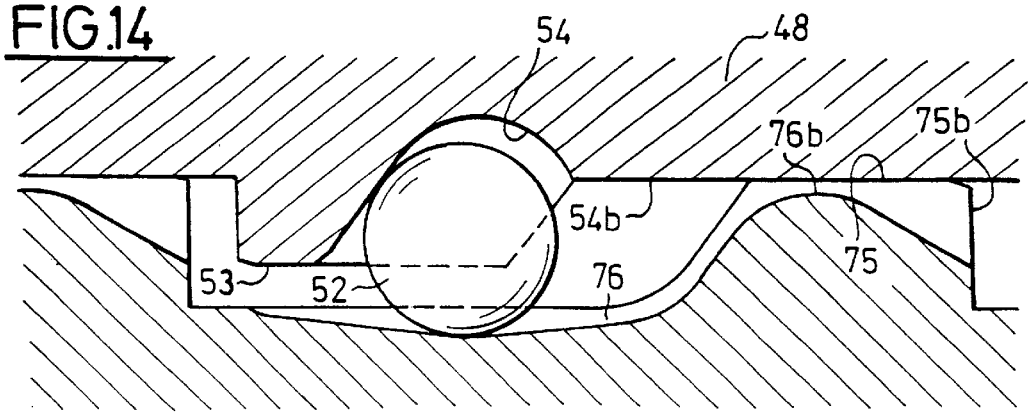

PNEUMATIC SCREWDRIVER

BACKGROUND OF THE INVENTION

1. Field of the Invention

The present invention concerns a pneumatic screwdriver.

The invention is directed to a pneumatic screwdriver having a body with means for connection to a compressed air feed hose at one end and a tool at the other end, said body containing a pneumatic motor driving a tool through a kinematic coupling with an interposed torque limiter.

2. Description of the Prior Art

Screwdrivers of this kind are well known and in widespread use in many industries to assemble parts very fast with the assurance that screws and nuts are tightened to a constant torque.

One drawback of the torque limiters provided in such screwdrivers is that they are complex, bulky and generate friction with the result that the tightening torque is not constant. Moreover, they are difficult to adjust. Finally, it is difficult to mass produce torque limiters having a tightening torque of consistent accuracy.

Another drawback is that after the tool has stopped when the required torque is achieved the motor, which rotates at high speed, continues to rotate, which causes modification of the next torque value.

One aim of the present invention is to remedy these various drawbacks.

SUMMARY OF THE INVENTION

The screwdriver in accordance with the invention is of the type having a casing with means at one end for connection to a compressed air feed hose supplying a pneumatic motor housed in said casing, means for controlling the supply of compressed air to the motor, the latter being connected by a kinematic coupling to a tool with an interposed torque limiter adapted to shut off the supply of compressed air to the pneumatic motor when the torque reaches a particular threshold, said torque limiter comprising a first positive clutch connected to the drive shaft, a second positive clutch connected to the kinematic coupling for driving the tool and balls inserted between said positive clutches, in which screwdriver said first positive clutch has on its face facing towards the other positive clutch three teeth offset by 120° and the free end of which is plane, each tooth having a steep face at one end and a recess at the other end connected at one end to said plane free end via an inclined ramp and at the other end to a stepped portion, a ball being inserted in each recess, and the corresponding face of said second positive clutch includes three teeth offset by 120°, the gaps between said teeth having a groove for guiding three balls inserted between said positive clutches, each groove having an ascending slope, a boss in each tooth and a slightly inclined slope, and each tooth of said second positive clutch has a plane free end with an inclined part at one end and a steep face at the other end, said teeth of said first positive clutch being disposed asymmetrically relative to those of said second positive clutch, the face of said first positive clutch opposite that facing said second positive clutch cooperating with one end of a compression spring the other end of which bears against a guide attached to an adjustment plate mobile on said drive shaft which has a screwthreaded part onto which is screwed a nut for adjusting the tension of said spring, said first positive clutch being connected to a valve so that, when the torque reaches a particular threshold, said balls escape from said boss of said groove of said second positive clutch, said first positive clutch shuts off the supply of compressed air and, after escaping from said bosses, said balls being free in said grooves, said teeth of said two positive clutches slide on each other in order to brake said motor.

This yields a torque limiter that is very simple and compact, which can be located near the tool and in which the torque can be constant.

Obviously the time for which the compressed air supply is shut off can be as short as possible.

Because the torque limiter can be disposed between two step-down gears, for example, the torque can be adjusted to a low value.

Fine adjustment of the moment of the torque limiter is also possible, and is obtained by screwing in or unscrewing the nut.

To enhance the braking action of the motor, the depth of each recess on the first positive clutch is such that, after the torque has been exceeded and the teeth have escaped, the teeth of the second positive clutch bear against the stepped portions between the teeth of the first positive clutch.

In accordance with one constructional feature, the drive shaft comprises a sleeve within which is mobile a piston attached to one end of a rod the other end of which cooperates with a cage mobile in a casing against the action of a spring, the cage containing balls and being connected to the rod of the valve, the piston being connected to the first positive clutch so that, when the torque has reached a particular threshold, it is pushed so that the rod moves the cage in the casing until said balls escape therefrom, the rod of the valve being adapted to be inserted in the cage so that the latter is shut off by the incoming flow of air.

The position of the casing in which the cage is mobile is adjustable so that the screwdriver can easily be adjusted to a particular torque during assembly.

In accordance with one constructional feature the drive shaft incorporates an elongate slot through which passes a pin attached to the piston and disposed so as to be able to cooperate with a ring attached to the first positive clutch when the torque has reached a particular threshold.

In one embodiment, the screwdriver comprises a step-down gear connected to the output shaft of the motor and the drive shaft is mounted on and keyed to the output shaft of the step-down gear, the torque limiter and tool system being guided to slide in the casing, the drive shaft being connected to a valve for admitting compressed air to the motor that is normally closed and which is opened by exerting pressure on the tool. This means that, although the compressed air feed to the motor remain open, it can be shut off by removing the pressure from the tool, which is advantageous because when the torque has been reached and the motor has stopped the feed can be controlled simply by applying pressure to the tool.

Finally, in accordance with a final feature, the drive shaft is a sleeve in which is mobile a piston attached to one end of a rod the other end of which cooperates with a cage mobile in a casing against the action of a spring, the cage including balls and being connected to the rod of the valve for admitting compressed air to the motor, the piston being connected to the first positive clutch so that, when the torque has reached a particular threshold, the piston is pushed so that the rod moves the cage in the casing until the balls escape therefrom, the rod of the valve being adapted to be inserted in the cage so that the valve is closed by the incoming flow of air, the valve being mounted so that it remains closed when no pressure is applied to the tool.

The invention will now be described in more detail with reference to particular embodiments shown by way of example only in the appended drawings.

BRIEF DESCRIPTION OF THE DRAWINGS

FIGS. 8 through 14 are schematic views showing the various phases of operation of the torque limiter.

DETAILED DESCRIPTION OF THE PREFERRED EMBODIMENTS

Figure 1:
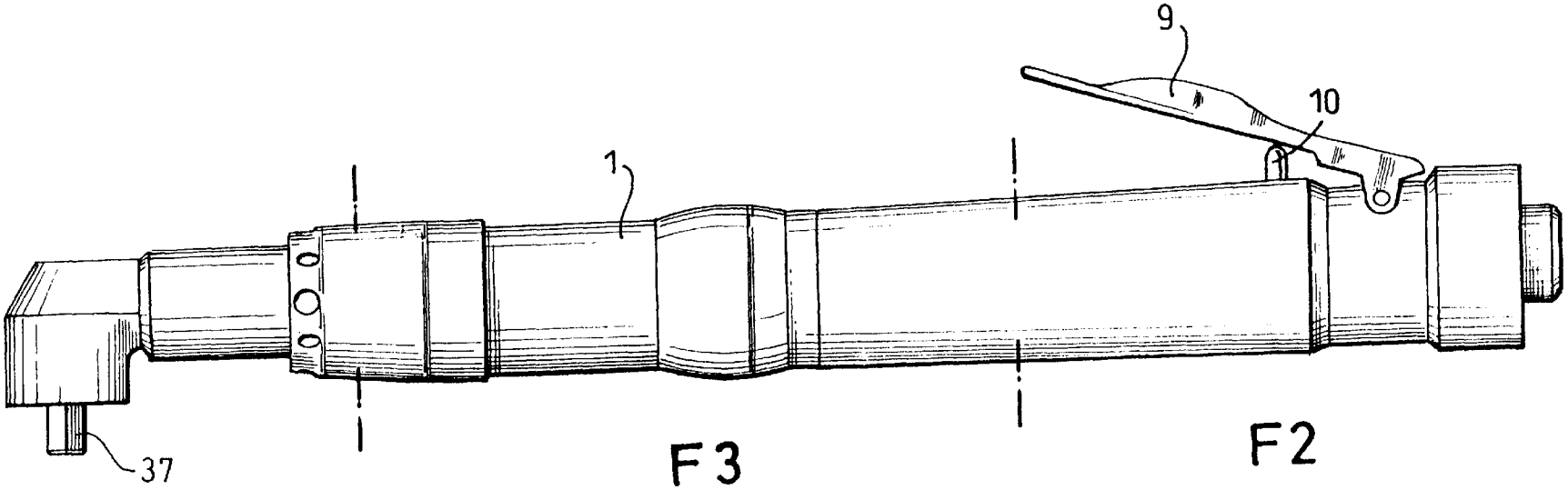
FIG. 1 is an elevation view of a pneumatic screwdriver in accordance with the invention.

FIG. 1 shows an angled screwdriver having a casing 1 housing a pneumatic motor 2.

The casing 1 has a connector 3 at one end for attaching a compressed air feed hose, the air exhausting via peripheral ports 4 at the rear end of the casing through washers 5 designed to reduce noise.

A trigger 9 is pivoted to the casing 1 about a pin 8 and cooperates with a plunger 10 mobile in a transverse bore 11 and adapted to bear against the ball 12 of a ball valve which is spring-loaded by a spring 14 against a seat 15. When the trigger 9 is depressed the plunger 10 frees the ball 12 from its seat to admit compressed air. To the rear of the seat 15 is a valve 18 having a seat 18*a* and a valve member 18*b* carried by one end of a rod 19 guided in a passage 20 in a casing case 21 in which a cage 22 moves against the action of a spring 23. A passage 16 downstream of the seat constitutes a purge for evacuating air trapped between the valve 18 and the ball valve.

The casing 21 is screwed into a screwthread 25 so that its position can be modified for extremely easy adjustment of the screwdriver to a particular torque.

Figure 2:
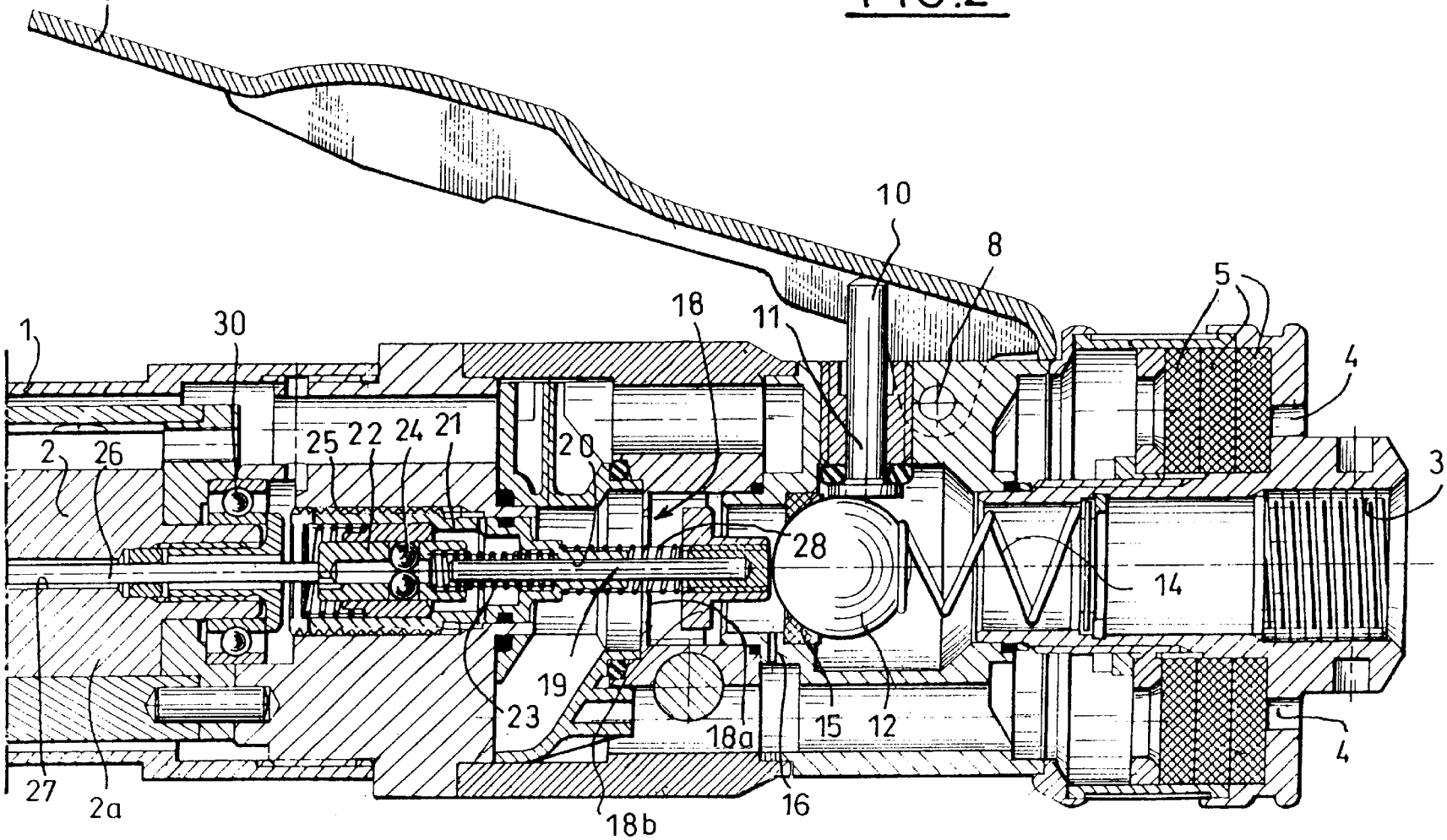
FIG. 2 is a sectional view to a larger scale of the rear part F2 of the screwdriver in accordance with the invention.

The cage 22 is pushed by one end of a rod 26 that slides freely in a passage 27 in the rotor 2*a* of the pneumatic motor 2 and the ends of which are guided in ball bearings 30. The cage 22 includes two balls 24 which are housed in the casing 21 and which can move apart when the rod 26 pushes said cage 22. When the cage 22 is moved by the rod 26 the balls 24 escape from said cage. The flow of air pushes the valve member 18*b* against the seat 18*a* and the rod 19 is pushed against the action of a spring 28 to a point in the vicinity of the back of the cage 22 (FIG. 2).

The rotor 2*a* drives a torque limiter system 35 through a step-down gear 31, the system 35 being connected by a kinematic coupling to a angled tool 37 through a second step-down gear 40.

A sleeve 44, which constitutes the drive shaft and onto which is screwed an adjuster nut 42 on which bears an adjuster plate 43 attached to a guide 46 for a compression spring 47 the free end of which bears against a first positive clutch 48 attached to a ring 49 and adapted to slide on the sleeve 44, is keyed to the output of the step-down gear 31.

The rod 26 is pushed by a piston 55 mobile in a bore 56 of the sleeve 44 with a compression spring 58 interposed between a shoulder 59 on said sleeve and said piston 55.

The piston 55 is fixed to a pin 60 which passes through elongate slots 61 of the sleeve 44 to form an abutment limiting the sliding of the piston 55.

A second positive clutch 50 is keyed to the sleeve 44, balls 52 being inserted between said positive clutches.

The positive clutch 48 includes three teeth 53 offset by 120° in each of which is a recess 54 terminating at one end in an inclined ramp 54*a* and opening at the other end onto a recessed portion 54*b*.

The second positive clutch 50 has three teeth 75 offset by 120°. The gaps between two teeth 75 include a groove 76 with an ascending slope 76*a*, a boss 76*b* and a slightly inclined slope 76*c*.

The boss 76*b* is located in the tooth 75 and each tooth has an inclined part 75*a* on the same side as the ascending slope 76*c* and a steep face on the opposite side. The teeth 53 also have an inclined part 53*a* and a steep face 53*b*.

The free ends of the teeth 53 and 75 are flat, or planar as can be seen in the various figures.

In normal operation the spring 47 presses the positive clutch 48 against the balls 52, of which there are three, housed in the recesses 54 and the grooves 76.

The sleeve 44 is attached to the positive clutch 48 which is housed in a bell 78 in which is mounted the second positive clutch 50 which cooperates with drive means 39 for the tool 37.

The free end of the sleeve 44 is guided in a ball bearing 41 and the bell 78 is connected to the drive means 39 for the tool by the balls 45 so that the bell can retract freely when the torque is reached.

FIGS. 8 through 14 represent the various phases of operation of the torque limiter.

Figure 5:
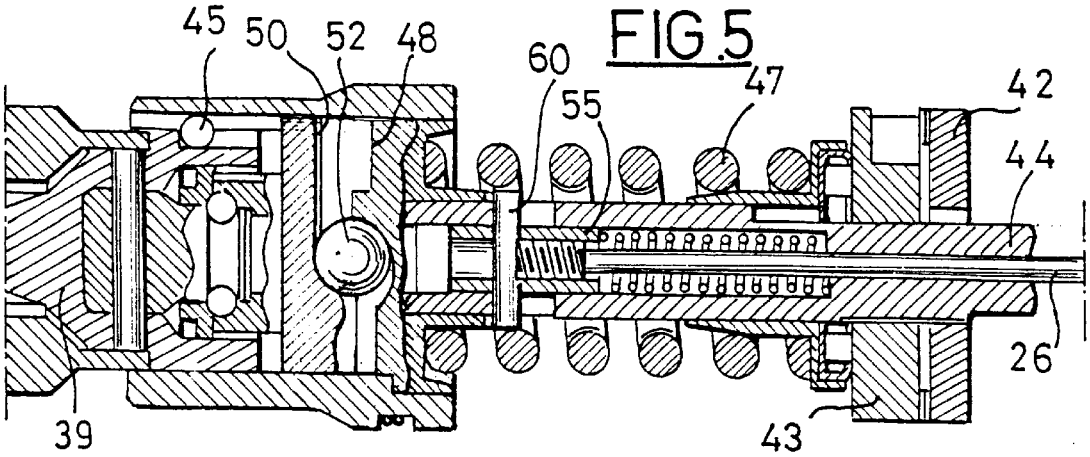
FIGS. 5, 6 and 7 are sectional views showing how the torque limiter system works.

In normal operation the balls 52 are immobilized between the ramp 54*a* and the ascending slope 76*a* of the groove 76 (see FIGS. 5 and 8).

When the torque increases the balls 52 move along the ascending slope 76*a*, which they tend to move down, and roll along the ramps 54 towards the free end of the teeth 53 (see FIG. 9).

Figure 6:
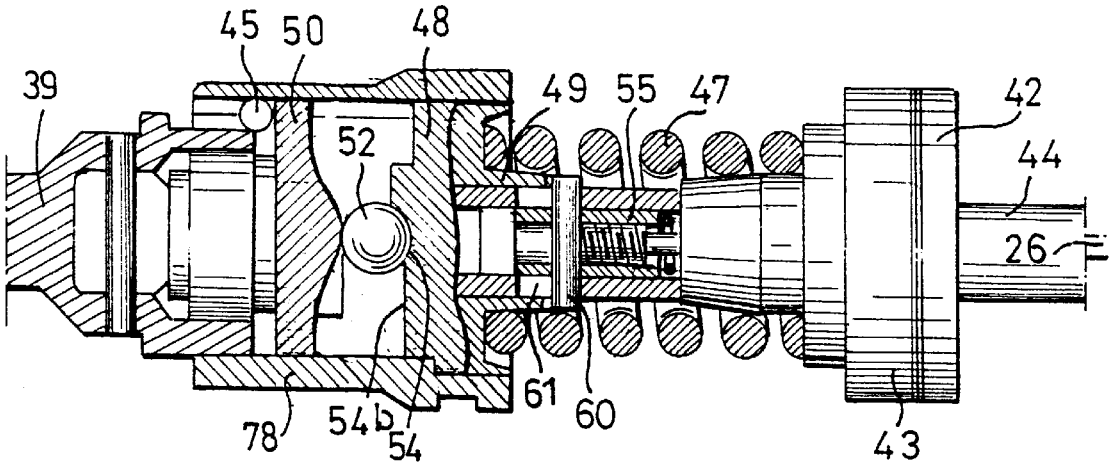
Figure 10:
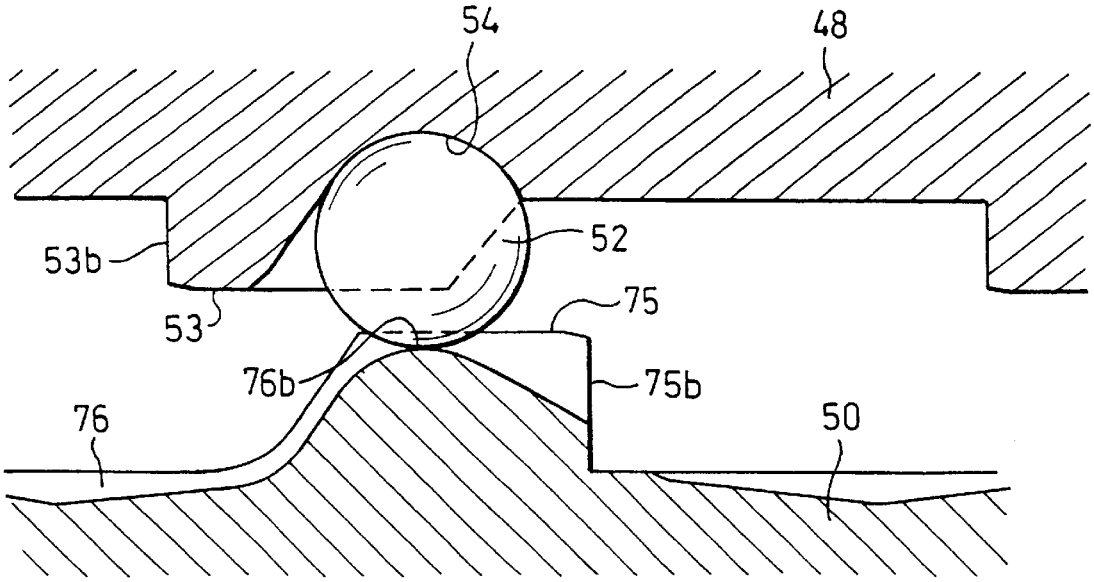
Figure 11:
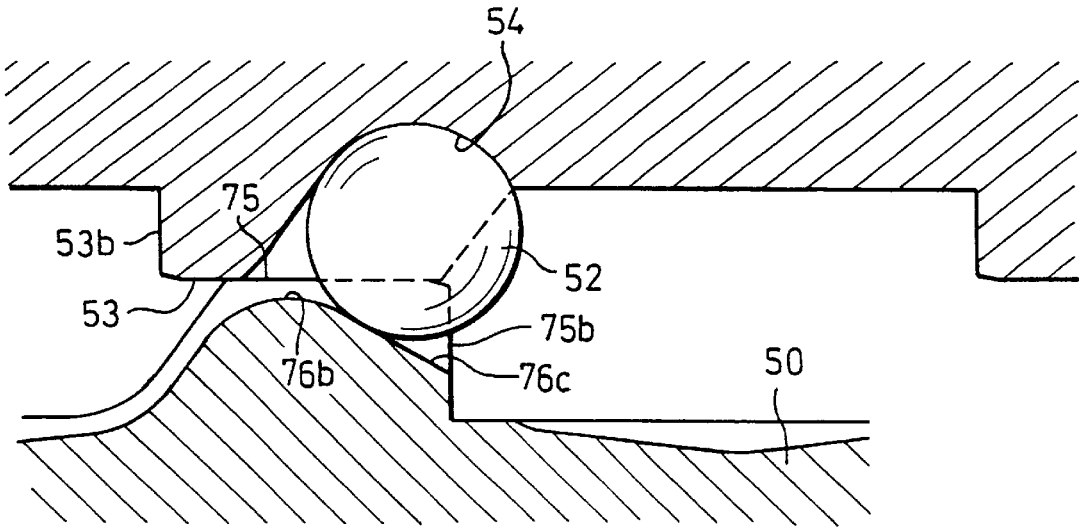
Figure 15:
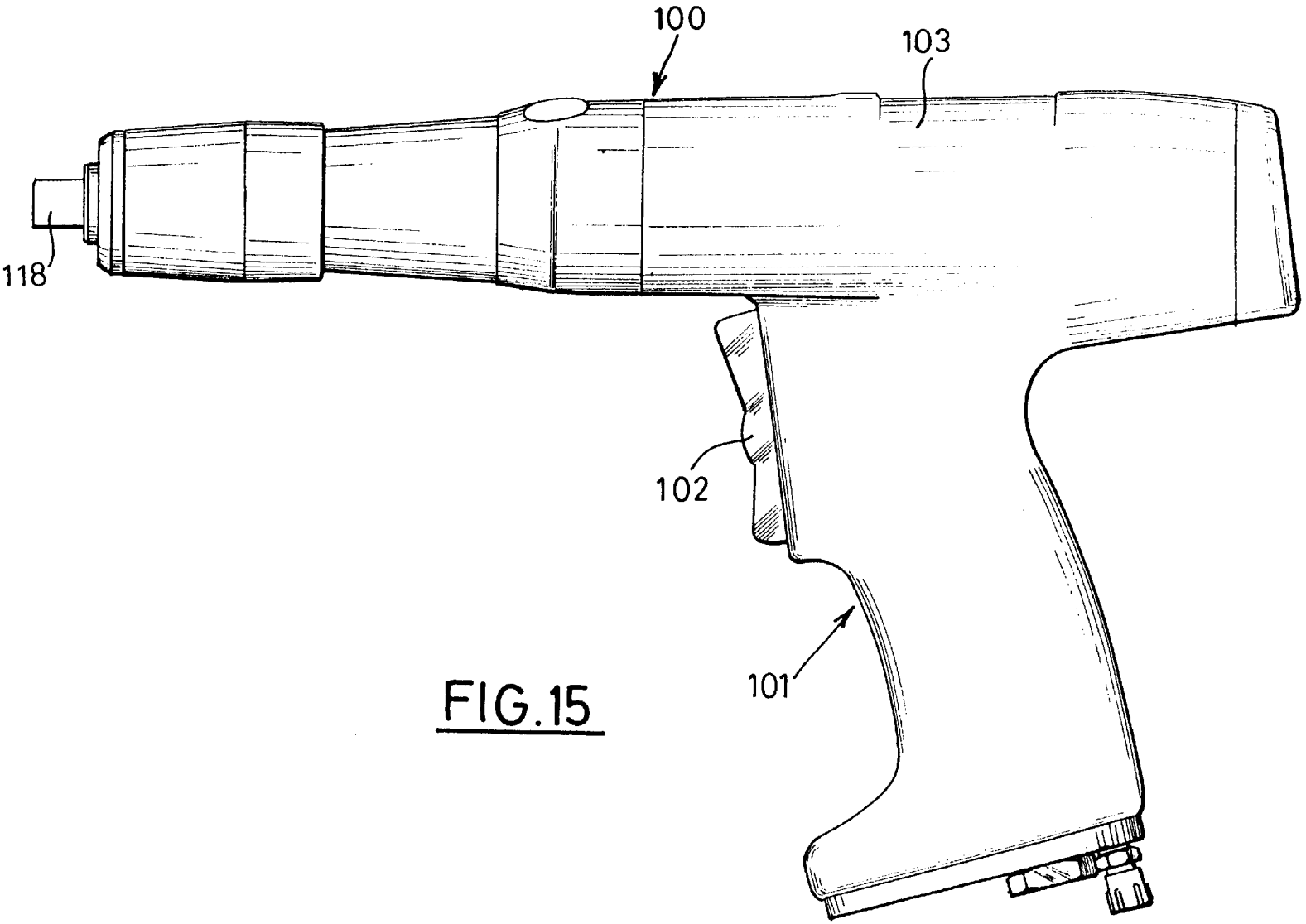
FIG. 15 is an elevation view of an alternative embodiment.
Figure 16:
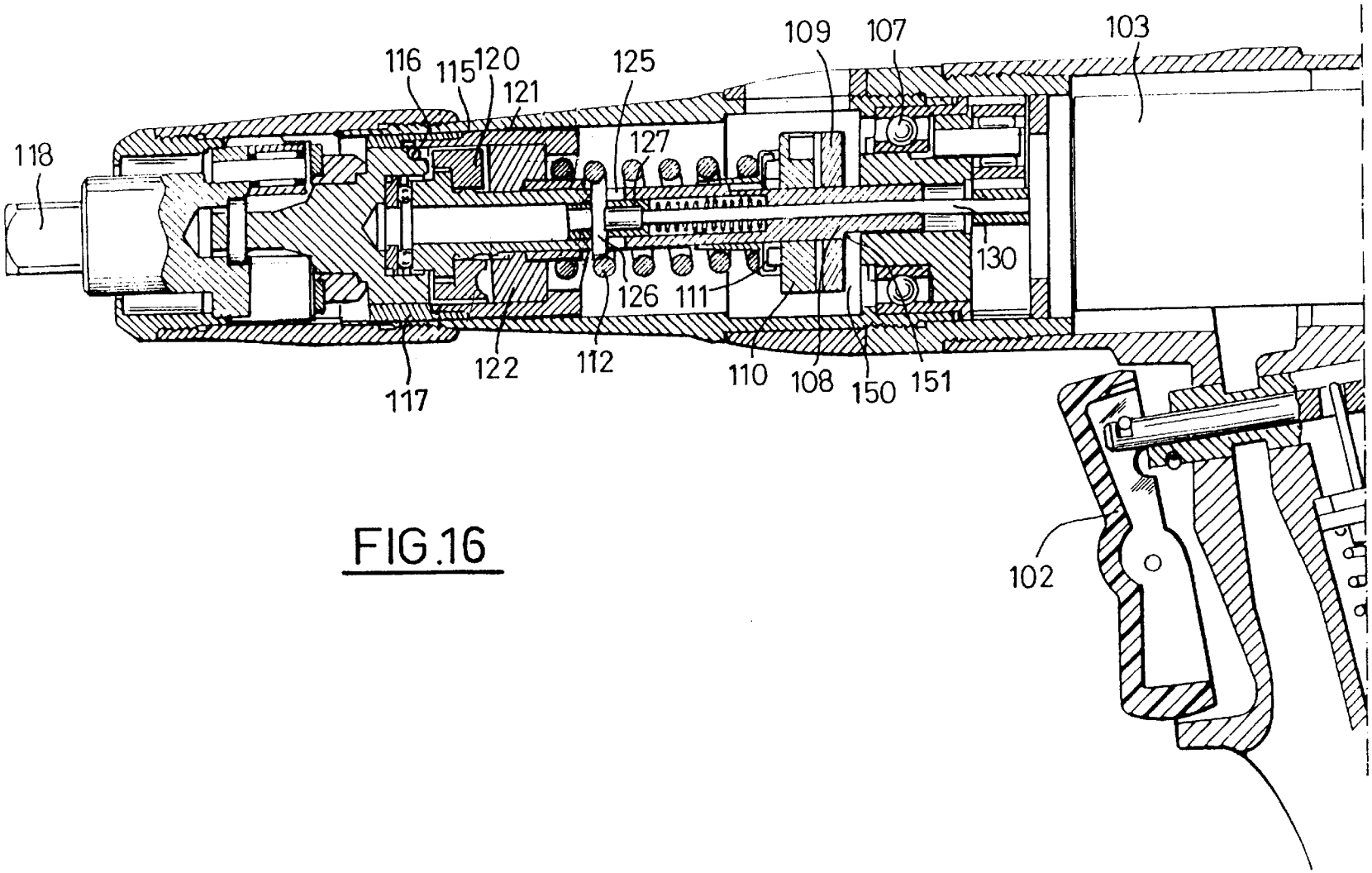
FIG. 16 is a sectional view to a larger scale of the part F4 of the screwdriver from FIG. 15.

If the torque continues to rise the balls reach the end of the bosses 76*b* and engage in the recesses 54 (see FIGS. 6 and 10).

In this position the ring 49 abuts against the pin 60 which moves the piston 55 so that the rod 26 pushes the cage 22, the balls 24 of which escape from the casing 21, with a result that the valve 18 pushed against the seat 18*a* by the flow of air and so shuts off the entry of air.

Figure 7:
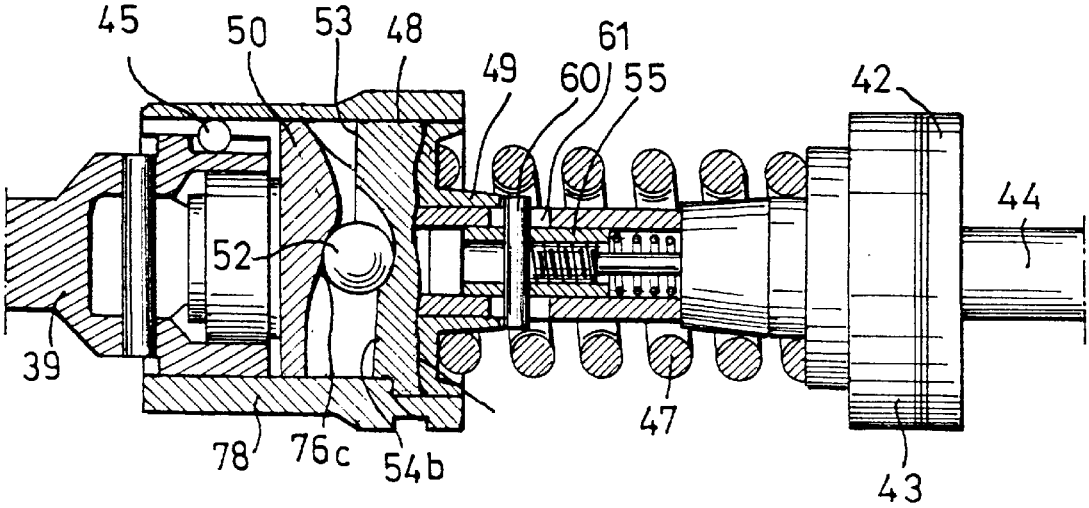

The tool is therefore stopped, but because of the inertia of the motor the positive clutch 48 continues to turn and the balls 52 remain in the recesses 54, beginning to roll on the slightly inclined slopes 76*c*. In this position the teeth 53 and 75 abut against each other at their free end (see FIGS. 7 and 11) which brakes the motor.

Figure 3:
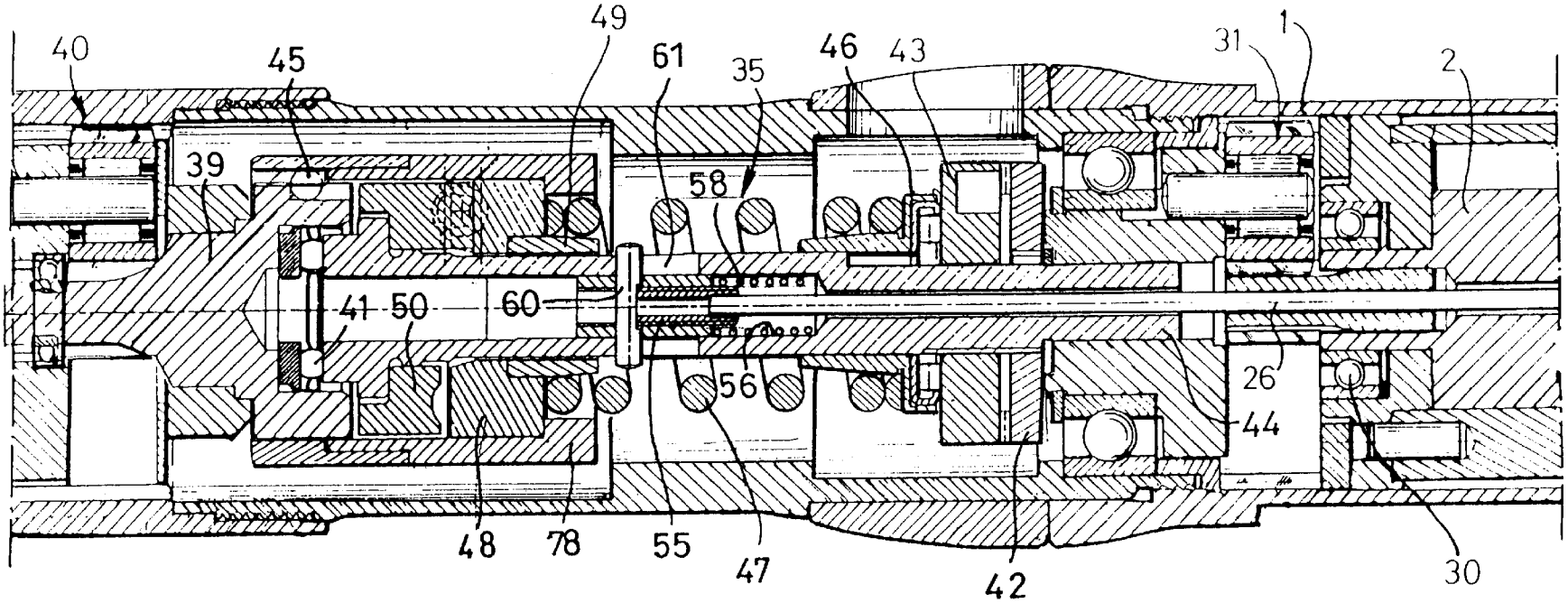
FIG. 3 is a sectional view to a larger scale of the central part F3 of the screwdriver in accordance with the invention.
Figure 4:
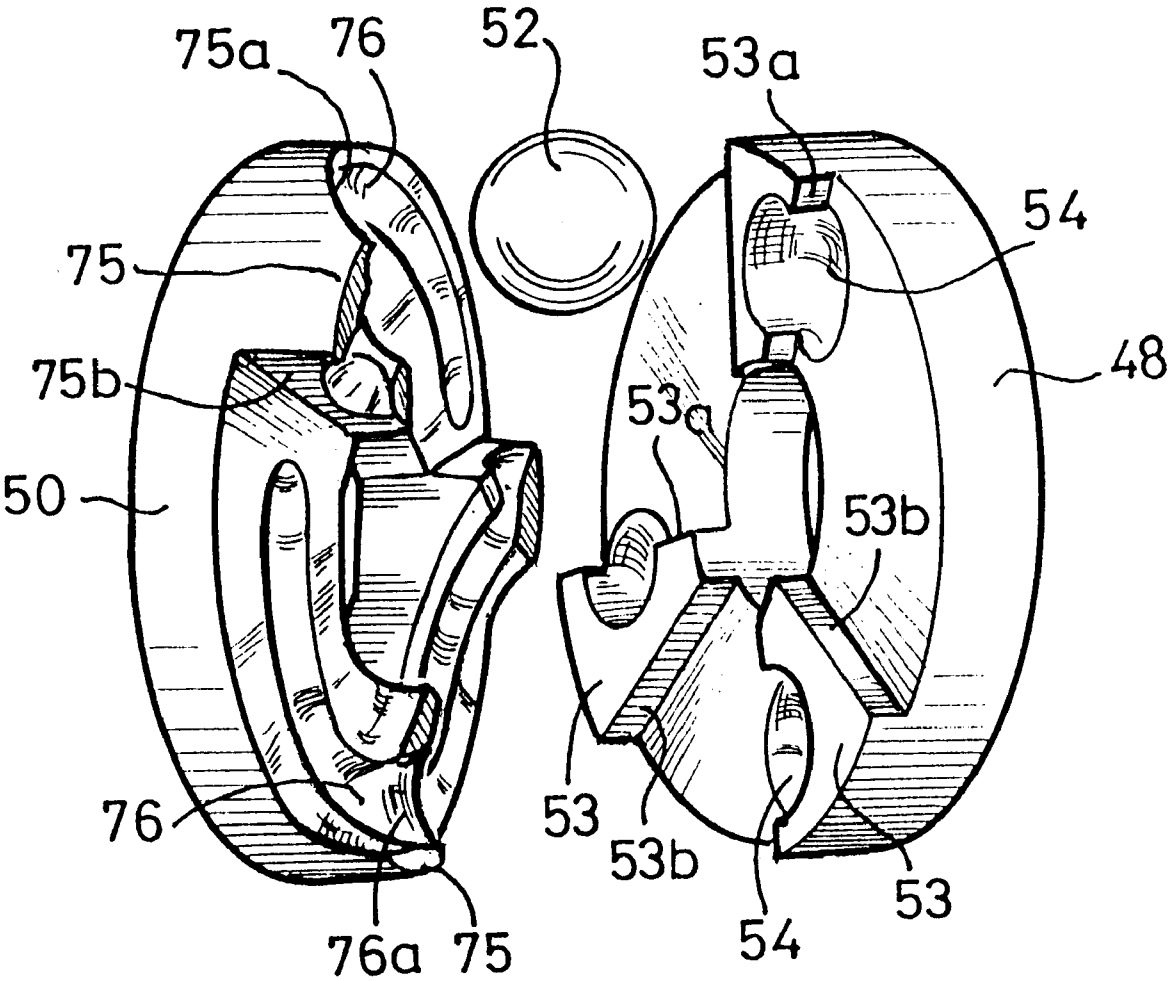
FIG. 4 is a perspective view of the components of the positive clutch of the torque limiter system.

The teeth 53 and 75 continue to rub on each other until the steep faces 53*b* and 75*b* are facing each other (FIG. 3).

When the teeth 53 and 75 rub on each other and the balls 52 approach the end of the slightly inclined slopes 76*c* opposite the dome the balls 52 are free but retained laterally by the groove 76 and the recesses 54 (see FIG. 12).

When the teeth 53 and 75 have escaped, the ramps 54*a* push the balls 52 towards the ascending slopes 76*a* (see FIG. 14) to move them towards the operating position (see FIGS. 5 and 8).

Note that the balls 52 remain free until the operating position is reached (FIGS. 5 and 8) with the result that the recessed portions 54*b* bear against the teeth 75 so that braking of the motor continues even after the teeth 53 and 75 escape (see FIG. 14).

To restart the screwdriver it is necessary to release the trigger 9 so that the ball 12 returns to its seat 15 whereupon, the compressed air feed being shut off, the valve member 18*b* escapes from its seat 18*a* due to the action of the spring 28 and the cage 22 returns to its initial position (see FIG. 2).

Pressing the trigger 9 again reconnects the motor to the compressed air supply to operate the screwdriver.

FIGS. 15 through 19 show an alternative embodiment of the invention.

In the latter embodiment the screwdriver comprises a body 100 with a pistol grip 101 and a trigger 102 controlling the admission of compressed air to a pneumatic motor 103, the grip incorporating a compressed air feed passage 104 incorporating a valve 105 controlled by the trigger 102 and an exhaust passage 106.

The motor 103 drives a shaft 108 through a step-down gear 107, the latter shaft comprising a sleeve onto which is screwed an adjuster 109 cooperating with an adjuster plate 110 attached to a guide 111 for a compression spring 112 the free end of which bears against a positive clutch 122 housed in a bell 117 in which is also housed a second positive clutch 120 connected to a member 118 adapted to receive a tool.

The bell 117 is mechanically coupled to the positive clutch 120 by balls 116.

The positive clutches 120 and 122 are identical to the positive clutches 48 and 50 and will not be described in detail hereinafter.

A pin 126 passes through an elongate slot 125 in the sleeve 108 and is attached to a piston 127 mobile in the sleeve and fastened to one end of a rod 130 passing axially through the motor, its other end abutting against a cage 131 mobile in a casing 132 against a spring 133.

A valve 135 cooperates with a seat 136 and is attached to a rod 137, a spring 138 spring-loading said valve away from its seat.

The cage 131 houses balls 140 which, when the cage is pushed by the rod 130, enable the rod 137 to engage in said cage so that the flow of air closes the valve when the torque has reached the value at which screwing is to be deemed to be complete.

Operation is identical to that of the first embodiment and will not be described in more detail.

The important modification compared to the first embodiment is that the combination of the member 118 and the sleeve 108 slides relative to and is keyed to the output of a step-down gear 107, a small gap 150 being provided between said step-down gear and a shoulder 151 on the sleeve 108.

Figure 17:
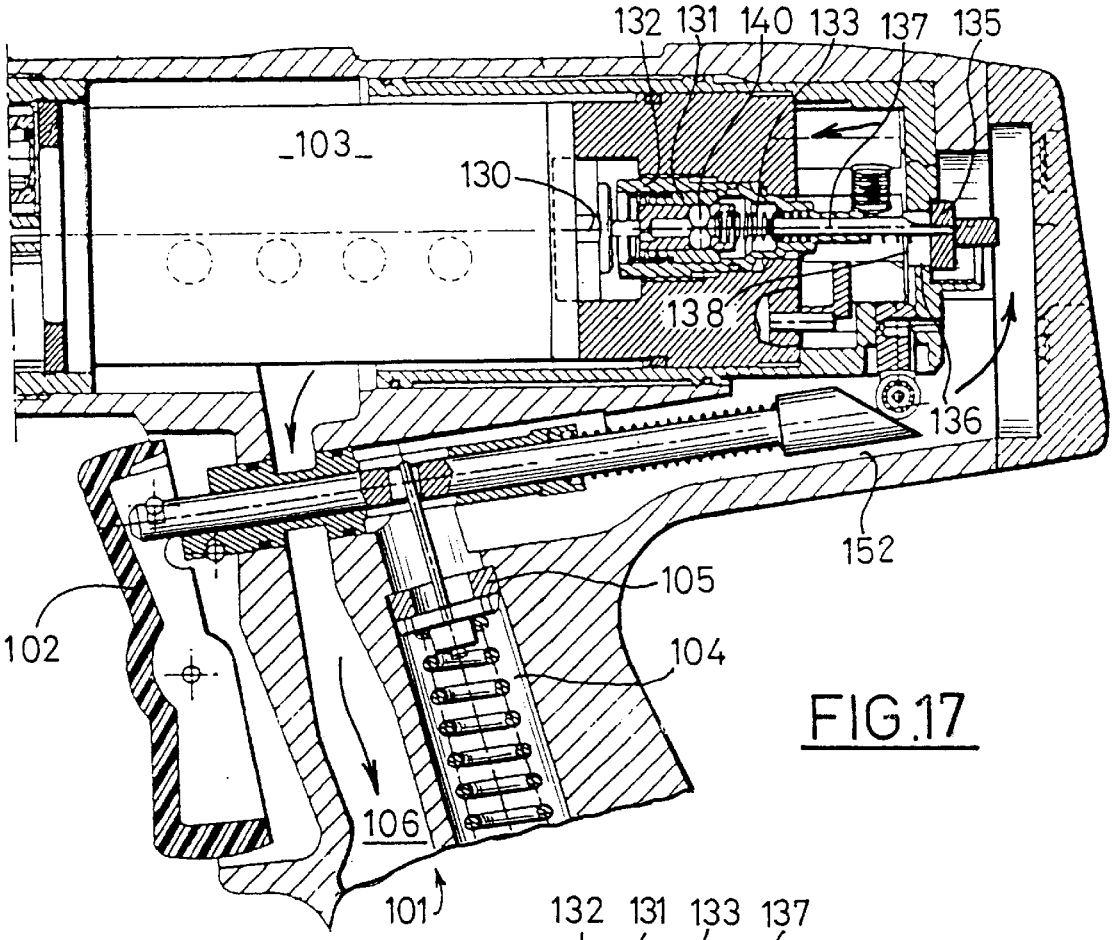
FIG. 17 is a sectional view to a larger scale of the part F5 of the screwdriver from FIG. 15.
Figure 19:
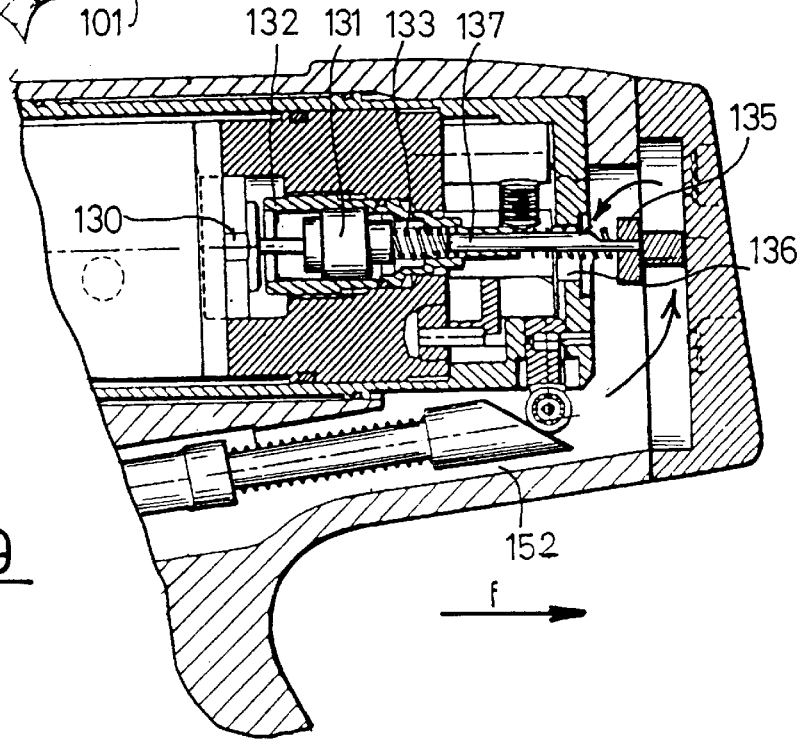
FIGS. 18 and 19 are partial sectional views showing the screwdriver in the working position.
Figure 18:
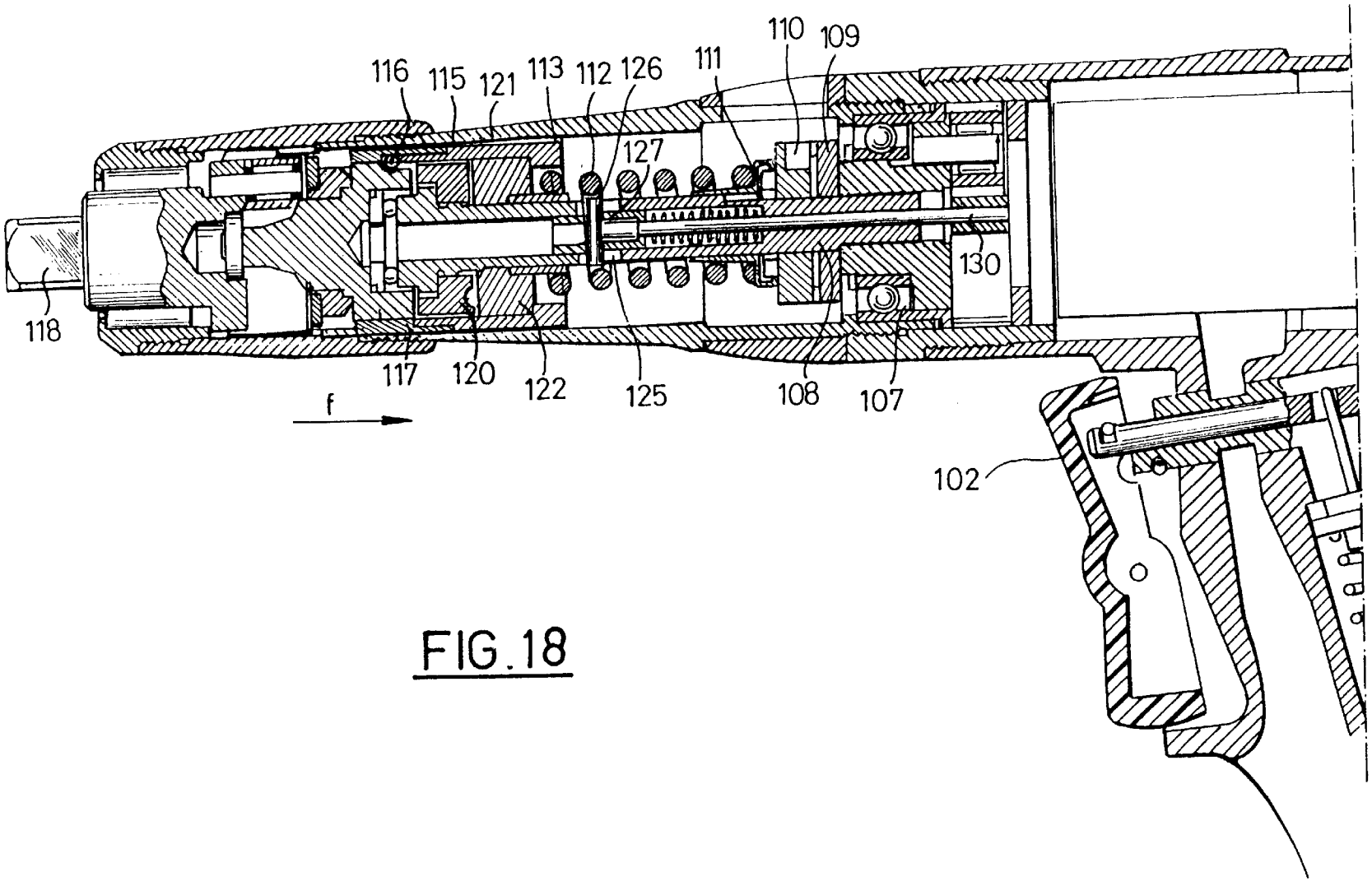

As can been seen in FIG. 17, the valve 135 is normally pressed onto its seat 136. Pressing the trigger 102 admits air to the motor 103 but the compressed air arriving via the passage 104, the valve 105 in which is open, enters a chamber 152 and cannot feed the motor because the passage is shut off by the valve 135.

When the user applies the tool fixed to the member 118, all of the assembly from the member 118 to the sleeve 108 slides in the direction of the arrow f (see FIG. 19), the shoulder 151 abutting against the step-down gear 107. During this movement the rod 130 slides in order to push the cage 131 so that the rod 137 is also pushed in the direction of the arrow f to open the valve 135. The motor 103 then starts and the screwing operation can be carried out (see FIG. 19).

Note that the travel of the cage 131 is insufficient, when pressure is applied to the member 118 to carry out screwing, for the balls 140 to escape from the casing 132, with the result that the valve 135 is held open. However, when the torque reaches the predetermined threshold the positive clutch 122 is separated from the positive clutch 120 and the cup 113 pushes on the pin 126 which, via the piston 127, moves the rod 130 a distance such that the balls 140 of the cage 131 escape from the casing 132, the rod 137 of the valve 135 then being free, and the flow of air presses the valve 135 against its seat 136.

Because the tightening torque has been reached, the user releases the pressure previously applied to the member 118 with the result that the latter returns to its initial position, although the screwdriver does not restart because the valve 135 is still closed, the spring 133 returning the cage 131 to its initial position so that the balls 140 inserted in said cage rearm the system so that all that is required to restart the screwdriver is to apply pressure to the member 118.

This feature is advantageous because the tool can be moved from one screw to the next after the torque has been reached without having to release the trigger 102, which is held in the depressed position.

Of course, the invention is not limited to the embodiments just described and shown. Many modifications of detail can be made thereto without departing from the scope of the invention.

There is claimed:

1. A pneumatic screwdriver comprising:

a casing having a connection for a compressed air feed hose;

a pneumatic motor positioned within said casing and a drive shaft in driven connection with said pneumatic motor;

a control for supplying compressed air from said compressed air feed hose to said pneumatic motor;

a member adapted to receive a driving tool and a kinematic coupling between said pneumatic motor and said member; and a torque limiter for said pneumatic motor, operably interposed between said pneumatic motor and said member, for (1) terminating compressed air being supplied to said pneumatic motor and (2) braking said pneumatic motor, in response to torque generated by said pneumatic motor reaching a particular threshold, said torque limiter comprising:

a first positive clutch connected to said drive shaft;

a second positive clutch connected to said kinematic coupling for driving said member; and a plurality of balls positioned between and retained on respective facing surfaces of said first positive clutch and said second positive clutch;

said first positive clutch having a surface opposite to said surface facing said second positive clutch, a compression spring having one end positioned in cooperation with said opposite surface of said first positive clutch;

an adjustment plate movably positioned on said drive shaft, a spring guide bearing on said adjustment plate, a second end of said compression spring being positioned on said spring guide, said adjustment plate having a screwthreaded part, a nut screwed onto said screwthreaded part of said adjustment plate for adjusting tension of said compression spring;

said first positive clutch including three teeth offset by 120° on said facing surface of said first positive clutch, each of said three teeth having a planar free end surface facing said second positive clutch, each of said teeth being demarcated by two ends, one of said two ends having a steep face and a second of said two ends having a recess, each said recess of said second end of respective ones of said teeth being connected by an inclined ramp to said planar free end surface and being connected by a stepped portion to a steep face of an adjacent one of said teeth, each of said plurality of balls being positioned within a respective one of said recesses;

said second positive clutch including three teeth offset by 120° on said facing surface of said second positive clutch and three grooves, each of said three grooves being interposed between respective pairs of said teeth, each of said plurality of balls being guided by a respective one of said grooves, each of said grooves having an ascending slope, a boss in each of said teeth of said second positive clutch, and a slightly inclined slope, each of said teeth of said second positive clutch having a planar free end surface facing said first positive clutch, each of said teeth of said second positive clutch further being demarcated by two ends, one of said two ends having an inclined part and a second of said two ends having a steep face, said teeth of said first positive clutch being disposed asymmetrically relative to said teeth of said second positive clutch;

a valve operably connected with said first positive clutch and with said pneumatic motor for terminating compressed air being supplied to said pneumatic motor in response to said first positive clutch and said second positive clutch being spaced apart by said plurality of balls a particular increased amount upon said torque generated by said pneumatic motor reaching a particular threshold;

said plurality of balls, in response to increasing torque generated by said pneumatic motor, being moved by said first positive clutch along respective ones of said ascending slopes of said grooves of said second positive clutch to respective ones of said bosses of said grooves of said second positive clutch and, in response to torque generated by said pneumatic motor reaching said particular threshold, said first positive clutch and said second positive clutch becoming spaced apart said particular increased amount, whereby said first positive clutch operates said valve and thereby terminates said compressed air being supplied to said pneumatic motor, said plurality of balls being then moved by said first positive clutch from said bosses of said grooves of said second positive clutch and said planar free end surfaces of said teeth of said first positive clutch being engaged with said planar free end surfaces of said teeth of said second positive clutch for braking said pneumatic motor.

2. A pneumatic screwdriver according to claim 1, wherein:

each of said recesses of said first positive clutch has a determinate depth, said depth having a value for enabling said teeth of said second positive clutch to bear against said stepped portions between said teeth of said first positive clutch.

3. A pneumatic screwdriver according to claim 1, wherein:

said drive shaft comprises a sleeve;

said screwdriver further comprises:

a movable piston positioned within said sleeve of said drive shaft;

a rod having a first end attached to said piston;

a cage positioned for movement within a case, a pair of balls held in a particular position with said cage and movable with said cage within said case, said rod having a second end engaged in cooperation with a first end of said cage;

a spring positioned for opposing said movement of said cage;

a valve rod extending from said valve in a direction toward a second end of said cage;

said piston is operatively connected to said first positive clutch wherein, in response to said torque reaching said particular threshold, said first positive clutch pushes said piston to move said rod to move said cage within said case and to push said balls outside of said case to allow said valve rod to be inserted within said cage, thereby allowing said valve to terminate said compressed air being supplied to said pneumatic motor.

4. A pneumatic screwdriver according to claim 3, further comprising:

means for adjusting a position of said cage within said case.

5. A pneumatic screwdriver according to claim 3, wherein:

said sleeve includes an elongated slot;

a pin extends through said elongated slot and is attached to said piston;

a ring is positioned around said sleeve and is fixed with respect to said first positive clutch, whereby said ring becomes engaged with said pin in response to said torque reaching said particular threshold for pushing said piston.

6. A pneumatic screwdriver according to claim 1, further comprising:

a step-down gear having an output connected to said drive shaft, said drive shaft being keyed to said output of said step-down gear to slide relative to said step-down gear;

said torque limiter and said member adapted to receive a driving tool being guided to slide in said casing; and means, responsive to pressure being exerted on said driving tool, for opening said valve to admit compressed air to said pneumatic motor.

7. A pneumatic screwdriver according to claim 6, wherein:

said drive shaft comprises a sleeve;

said screwdriver further comprises:

a movable piston positioned within said sleeve of said drive shaft;

a rod having a first end attached to said piston;

a cage positioned for movement within a case, a pair of balls held in a particular position with said cage and movable with said cage within said case, said rod having a second end engaged in cooperation with a first end of said cage;

a spring positioned for opposing said movement of said cage;

a valve rod extending from said valve in a direction toward a second end of said cage;

said piston is operatively connected to said first positive clutch wherein, in response to said torque reaching said particular threshold, said first positive clutch pushes said piston to move said rod to move said cage within said case and to push said balls outside of said case to allow said valve rod to be inserted within said cage, thereby allowing said valve to terminate said compressed air being supplied to said pneumatic motor.

8. A pneumatic screwdriver comprising:

a casing having a connection for a compressed air feed hose;

a pneumatic motor positioned within said casing and a drive shaft in driven connection with said pneumatic motor;

a control for supplying compressed air from said compressed air feed hose to said pneumatic motor;

a member adapted to receive a driving tool and a kinematic coupling between said pneumatic motor and said member; and a torque limiter for said pneumatic motor, operably interposed between said pneumatic motor and said member, for (1) terminating compressed air being supplied to said pneumatic motor and (2) braking said pneumatic motor, in response to torque generated by said pneumatic motor reaching a particular threshold, said torque limiter comprising:

a first positive clutch connected to said drive shaft;

a second positive clutch connected to said kinematic coupling for driving said member; and a plurality of balls positioned between and retained on respective facing surfaces of said first positive clutch and said second positive clutch;

said first positive clutch having a surface opposite to said surface facing said second positive clutch, a compression spring having one end positioned in cooperation with said opposite surface of said first positive clutch;

an adjustment plate movably positioned on said drive shaft, a second end of said compression spring positioned in cooperation with said adjustment plate, and adjustment plate comprising means for adjusting tension of said compression spring;

said first positive clutch including a plurality of teeth, said teeth being circularly spaced apart a common amount on said facing surface of said first positive clutch, each of said teeth having a planar free end surface facing said second positive clutch, each of said teeth being demarcated by two ends, one of said two ends having a steep face and a second of said two ends having a recess, each said recess of said second end of respective ones of said teeth being connected by an inclined ramp to said planar free end surface and being connected by a stepped portion to a steep face of an adjacent one of said teeth, each of said plurality of balls being positioned within a respective one of said recesses;

said second positive clutch including a plurality of teeth, said teeth of said second positive clutch being circularly spaced apart by a common amount said facing surface of said second positive clutch, a plurality of grooves, each of said grooves being interposed between respective pairs of said teeth, each of said plurality of balls being guided by a respective one of said grooves, each of said grooves having an ascending slope, a boss in each of said teeth of said second positive clutch, and a slightly inclined slope, each of said teeth of said second positive clutch having a planar free end surface facing said first positive clutch, each of said teeth of said second positive clutch further being demarcated by two ends, one of said two ends having an inclined part and a second of said two ends having a steep face, said teeth of said first positive clutch being disposed asymmetrically relative to said teeth of said second positive clutch;

a valve operably connected with said first positive clutch and with said pneumatic motor for terminating compressed air being supplied to said pneumatic motor in response to said first positive clutch and said second positive clutch being spaced apart by said plurality of balls a particular increased amount upon said torque generated by said pneumatic motor reaching a particular threshold;

said plurality of balls, in response to increasing torque generated by said pneumatic motor, being moved by said first positive clutch along respective ones of said ascending slopes of said grooves of said second positive clutch to respective ones of said bosses of said grooves of said second positive clutch and, in response to torque generated by said pneumatic motor reaching said particular threshold, said first positive clutch and said second positive clutch becoming spaced apart said particular increased amount, whereby said first positive clutch operates said valve and thereby terminates said compressed air being supplied to said pneumatic motor, said plurality of balls being then moved by said first positive clutch from said bosses of said grooves of said second positive clutch and said planar free end surfaces of said teeth of said first positive clutch being engaged with said planar free end surfaces of said teeth of said second positive clutch for braking said pneumatic motor.

* * * * *